United States Patent [19]

Eltis

[11] Patent Number: 4,831,731

[45] Date of Patent: May 23, 1989

[54] MULTIPLE BLADE SAFETY RAZOR

[76] Inventor: Mirel Eltis, 6865 Norwalk, Apt. 806, Côte St. Luc, Montreal, Quebec, Canada, H4W 2X7

[21] Appl. No.: 178,920

[22] Filed: Apr. 7, 1988

[51] Int. Cl.[4] ..... B26B 21/22

[52] U.S. Cl. ..... 30/50; 30/41.6

[58] Field of Search ..... 30/41.6, 50, 51, 57, 30/58, 346.57, 346.58

[56] References Cited

U.S. PATENT DOCUMENTS

| | | | |
|---|---|---|---|
| 1,920,711 | 8/1933 | Pelizzola | 30/50 |
| 3,934,338 | 1/1976 | Braginetz | 30/50 X |
| 4,200,976 | 5/1980 | Gooding | 30/50 X |
| 4,501,066 | 2/1985 | Sceberras | 30/50 |
| 4,663,843 | 5/1987 | Savage | 30/50 X |
| 4,720,917 | 1/1988 | Solow | 30/51 X |

FOREIGN PATENT DOCUMENTS

| | | | |
|---|---|---|---|
| 0015761 | 2/1977 | Japan | 30/50 |

*Primary Examiner*—Frank T. Yost
*Assistant Examiner*—Michael D. Folkerts

[57] ABSTRACT

A manual razor comprises a shaving head and a handle that extends therefrom. The shaving head includes at least two pairs of dual razor blades, each blade having a single shaving edge. The dual blade arrangements are fixedly mounted on the shaving head in a substantially longitudinal manner in order that the shaving edges of all blades are exposed in a common plane. A skin engaging surface is provided between each dual blade arrangement for providing a closer shave.

6 Claims, 1 Drawing Sheet

MULTIPLE BLADE SAFETY RAZOR

BACKGROUND OF INVENTION

Field of the Invention

This invention relates to razors and more particularly to manual safety razors for wet shaving.

SUMMARY OF INVENTION

It is an aim of the present invention to provide an improved manual razor designed for giving a closer shave.

It is also an aim of the present invention to provide a manual razor having a shaving head and a blade arrangement designed for a better overall shave thereof.

It is also an aim of the present invention to provide a manual razor having a blade arrangement characterized by a skin-engaging surface between at least two of the blades in the blade arrangement for providing a close shave.

A construction in accordance with the present invention comprises a manual razor including a shaving head and a handle extending therefrom. At least two pairs of dual razor blades are provided on the shaving head. Each blade has a shaving edge. The dual blade arrangements are fixedly mounted in a substantially longitudinal manner on the shaving head, in order that the shaving edges thereof are exposed all in a same plane. The dual blade arrangements are spaced apart by a skin engaging surface.

A further aspect of the present invention comprises two pairs of dual razor blades spaced apart by the skin-engaging surface having a transverse dimension ranging between 7 and 11 mm.

BRIEF DESCRIPTION OF DRAWINGS

Having thus generally described the nature of the invention, reference will now be made to the accompanying drawings, showing by way of illustration, a preferred embodiment thereof, and in which.

DESCRIPTION OF PREFERRED EMBODIMENTS

Figure 1:
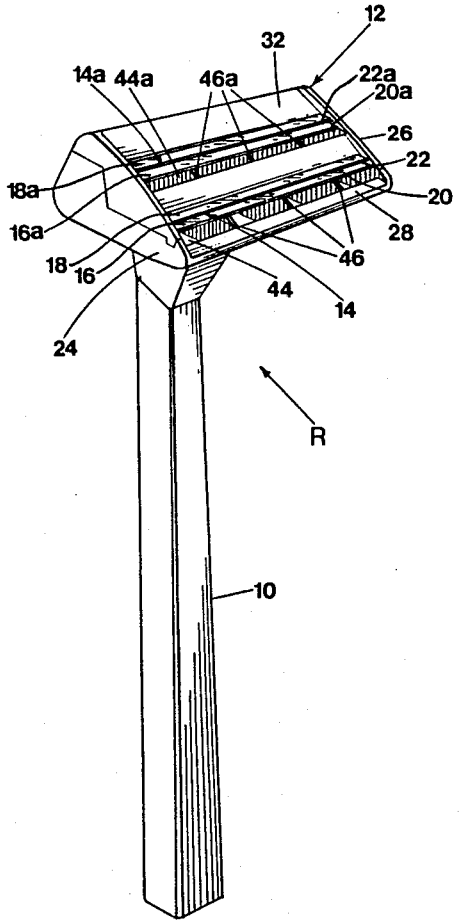
FIG. 1 is a perspective view of the manual razor.

Referring mainly to FIG. 1, a razor R includes a handle 10 and a shaving head generally shown as 12, mounted to the handle 10 at one end thereof. The handle 10 and the shaving head 12 are made of a hard moulded plastic, such as polystyrene. The shaving head 12 comprises a first and a second dual-blade arrangement 14 and **14*a*** respectively.

Each dual blade arrangement 14 and **14*a* comprises a pair of razor blades 16 and 18 and 16*a* and 18*a* respectively, as shown in FIG. 1. The razor blades 16, 16*a*, 18 and 18*a* respectively include a shaving edge 20, 20*a*, 22 and 22*a* made of chromed platinum or the like. The dual blade arrangement 14 and 14*a* is longitudinally mounted in the shaving head 12 between end walls 24 and 26** thereof.

Figure 3:
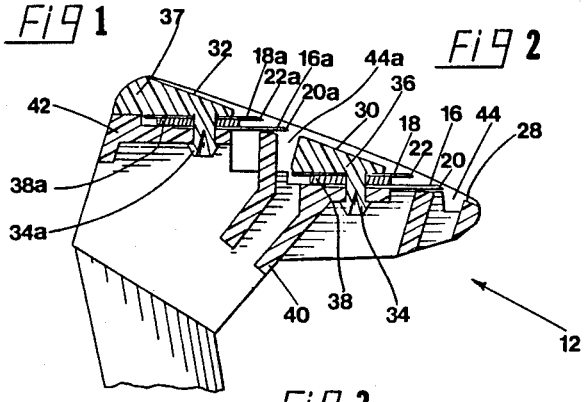
FIG. 3 is a cross-sectional side view showing the shaving head of the manual razor along lines 3—3 of FIG. 2.

The razor blades 16, **16*a*, 18 and 18*a* are fixedly mounted in a parallel manner to the general body of the shaving head 12, in order that the respective shaving edges 20, 20*a*, 22 and 22*a*, aside from being parallel, are exposed in a common plane, as best seen in FIG. 3**.

Mounting of the dual blade arrangements 14 and **14*a*** will be further described hereinafter.

Figure 2:
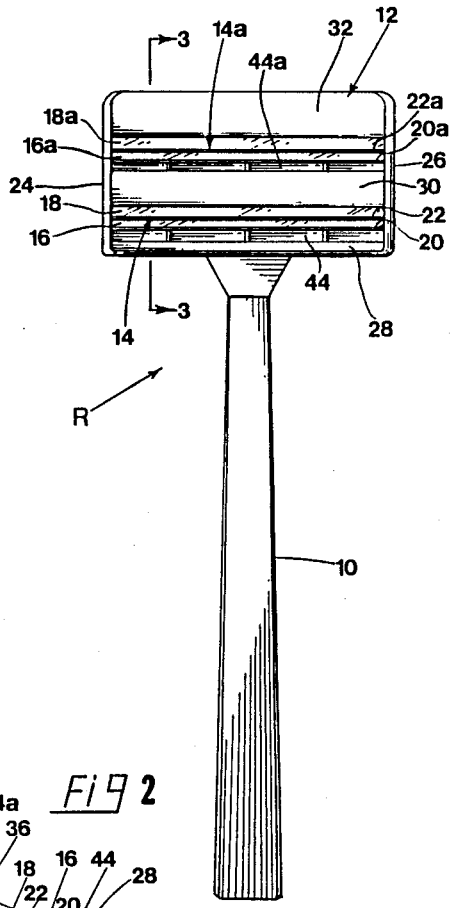
FIG. 2 is a front elevation of the manual razor.

Referring mainly to FIGS. 1 and 2, the shaving head 12 also includes first, second and third low friction skin-engaging surfaces 28, 30 and 32 respectively, which extend longitudinally between the end walls 24 and 26 of the shaving head 12 and transversely on each side of each of the dual blade arrangements 14 and **14*a*. The skin engaging surfaces 28, 30 and 32 are disposed substantially in a same plane, as best seen in FIG. 3, slightly inwardly of the common plane of the shaving edges 20, 20*a*, 22 and 22*a*. The first skin-engaging surface 28 prepares the skin and the whiskers for a shaving action from the first dual blade arrangement 14, whereas the second skin-engaging surface 30 prepares the same for shaving action from the second dual blade arrangement 14*a*. It has been found that a closer shave is achieved if the transverse extent, that is the distance between blade edge 20*a* and 22**, is between 7 and 11 mm.

The second skin-engaging surface 30 may allow the skin and the whiskers to return after the shaving action of the first dual blade arrangement 14 to a relaxed position thereof before encountering the shaving action from the second dual blade arrangement **14*a*. It is thus suggested that the second skin-engaging surface 30 may allow the unsevered whiskers to return to a substantially upstanding position relative to the skin before going through the second shaving action provided by the second dual blade arrangement 14*a***. Nevertheless, a closer shave is achieved.

Now referring to FIG. 3, each of the dual blade arrangements 14 and **14*a* is mounted to the shaving head 12 by way of respective rivets 34 and 34*a* which are respectively part of body portions 36 and 37 of the shaving head 12, which body portions respectively bear the second and third skin-engaging surfaces 30 and 32. Spacers 38 and 38*a* respectively separate the blades of each of the dual blade arrangements 14 and 14*a*, also providing parallelisms between each group of blades. Further body parts 40 and 42 of the shaving head 12, in conjunction with body portions 36 and 37 and rivets 34 and 34*a*, assist in maintaining in a parallel way the blades 16, 16*a*, 18 and 18*a*, and in providing the common plane for the shaving edges 20, 20*a*, 22 and 22*a***.

As seen in all figures, a first and second slot 44 and **44*a* are defined in the shaving head 12 respectively under shaving blades 16 and 16*a* for receiving and temporarily storing a certain amount of a mixture containing severed whiskers, lather and water. Such slots or passages are well known in the art. A first and second set of baffles 46 and 46*a* which are part of the shaving head 12, are respectively provided transversely within the slots 44 and 44*a***.

Consequently when shaving, the first skin-engaging surface 28 positions the skin for a first shaving carried out of the first dual blade arrangement 14, as severed whiskers, lather and water are temporarily stored in the first slot 44. Afterwards, the skin and the unsevered whiskers return to the normal position thereof when reaching the second skin-engaging surface 30 and are thus prepared for a second shaving which is now performed by the second dual blade arrangement **14*a*; thereagain, severed whiskers lather and water are stored in the second slot 44*a*. It is necessary to run the shaving head 12 under a faucet or to agitate it in water for clearing the slots 44 and 44*a*** in order to continue producing a close shave and to avoid irritation of the skin from the trapped severed whiskers.

A further embodiment, not shown in the drawings, proposes a shaving head that is removably mounted to a handle, whereas, in the illustrated embodiment, as described hereinabove, the whole razor is disposable.

In a still further embodiment of the present invention, which is also not shown in the illustrations, a shaving head is pivotally mounted to a handle, whereby a pivoting shaving head is produced which is also disposable.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A razor comprising a shaving head and a handle extending therefrom;

at least two razor blade arrangements each including a pair of closely spaced-apart substantially parallel razor blades each having a shaving edge;

said razor blades being fixedly mounted to the shaving head and extending generally longitudinally thereon for exposing the shaving edges thereof substantially in a common plane, said arrangements being separated by a low friction skin-engaging surface wherein said surface is substantially located in said common plane.

2. A razor as defined in claim 1, wherein the transverse dimension between an upper edge of said shaving edges of one of said arrangements and a successive lower edge of said shaving edges of an other of said arrangements ranges between 7 and 11 mm.

3. A razor as defined in claim 1, wherein slots are longitudinally defined in said shaving head adjacent said arrangements for temporarily receiving a mix of severed whiskers, lather and water.

4. A razor as defined in claim 3, wherein said shaving head comprises baffles transversely extending in said slots from said shaving head towards an internal surface of a lower blade of each of said arrangements.

5. A razor as defined in claim 1, wherein the shaving head and the handle are made of a moulded plastic.

6. A razor as defined in claim 5, wherein the moulded plastic is polystyrene.

* * * * *